US005983867A

United States Patent [19]

Stuber et al.

[11] Patent Number: 5,983,867

[45] Date of Patent: Nov. 16, 1999

[54] DEVICE AND METHOD FOR CONTROLLING THE AMOUNT OF FUEL SUPPLIED TO AN INTERNAL COMBUSTION ENGINE

[75] Inventors: Axel Stuber, Tamm; Hartmut Kischel, Ingersheim, both of Germany

[73] Assignee: Robert Bosch GmbH, Stuttgart, Germany

[21] Appl. No.: 08/956,565

[22] Filed: Oct. 23, 1997

[51] Int. Cl.[6] ..... F02M 51/00

[52] U.S. Cl. ..... 123/488; 123/478

[58] Field of Search ..... 123/488, 478, 123/491

[56] References Cited

U.S. PATENT DOCUMENTS

| | | | |
|---|---|---|---|
| 4,681,076 | 7/1987 | Muller | 123/478 |
| 4,814,997 | 3/1989 | Matsumura et al. | 123/488 |
| 4,844,042 | 7/1989 | Osano | 123/488 |
| 4,884,547 | 12/1989 | Tamura | 123/488 |
| 4,957,088 | 9/1990 | Hosaka | 123/488 |
| 4,986,244 | 1/1991 | Kobayashi et al. | 123/488 |
| 5,101,795 | 4/1992 | Hirschmann et al | 123/488 |
| 5,261,369 | 11/1993 | Vernier | 123/488 |
| 5,394,331 | 2/1995 | Dudek et al. | 123/488 |

FOREIGN PATENT DOCUMENTS

| | | |
|---|---|---|
| 0 264 332 | 4/1988 | European Pat. Off. . |
| 0 482 048 | 4/1992 | European Pat. Off. . |
| 44 44 416 | 6/1996 | Germany . |

*Primary Examiner*—John Kwon
*Attorney, Agent, or Firm*—Kenyon & Kenyon

[57] ABSTRACT

A device and method for controlling the amount of fuel supplied to an internal combustion engine as a function of operating characteristics such as the pressure in the intake manifold, the engine speed, coolant temperature and intake air temperature, where a load signal formed from pressure and engine speed values is corrected by a correction factor $F_{CORR}$ as a function of the temperature, and when forming the correction factor $F_{CORR}$, the influences of the engine temperature and/or the intake air temperature on the load sensing are weighted separately as a function of the operating point.

17 Claims, 1 Drawing Sheet

DEVICE AND METHOD FOR CONTROLLING THE AMOUNT OF FUEL SUPPLIED TO AN INTERNAL COMBUSTION ENGINE

FIELD OF THE INVENTION

The present invention relates to a device and method for controlling the amount of fuel supplied to an internal combustion engine in response to operating characteristics such as the pressure in the intake manifold, the engine speed, engine temperature and intake air temperature.

BACKGROUND INFORMATION

German Patent No. DE 44 44 416 describes a "Process for Influencing the Fuel Metering in an Internal Combustion Engine," and discusses the creation of a correction factor in fuel metering, where the values for the intake air temperature and the engine temperature are used to form variables that describe the heat flow to and from the intake system. This process takes into consideration the wall film behavior, which involves the deposition of fuel on the inside walls of the intake air manifold, and the air/fuel mixture supplied to the combustion chambers particularly for the non-steady operation of the internal combustion engine.

European Patent No. EP 482 048 describes a process for controlling an internal combustion engine, where a correction factor is derived to correct a basic value of the fuel. This correction factor is obtained from an engine characteristics map whose input variables are the intake air mass and the difference between the temperatures of the intake air and the cooling water.

Finally, European Patent No. EP 264 332 describes a temperature-dependent correction method for fuel metering using the difference between the temperatures of the coolant and the intake air, where this difference can be multiplied by a value that depends on engine speed and load.

A known shortcoming in these conventional systems is that they are not capable of yielding satisfactory results in all cases. Therefore, an object of the present invention is to optimize the equipment for controlling the amount of fuel to be supplied to an internal combustion engine in a wider array of cases than in the conventional systems.

SUMMARY OF THE INVENTION

In developing the present invention, the following assumptions are made:

For internal combustion engine controls with intake manifold pressure sensors for load sensing, the basic injection time is usually set as a function of intake manifold pressure and engine speed under standard conditions, i.e., when the engine is at the operating temperature and the ambient air temperature is 20° C.

When the engine temperature or intake air temperature differs from these standard conditions, the temperature of the air intake into the combustion chamber changes, and thus its density and mass also change. Therefore, to maintain a desired air/fuel ratio, the amount of fuel injected must be corrected as a function of the intake air and engine temperature.

The required correction factor is inversely proportional to the absolute gas temperature in the combustion chamber at the end of the intake process. Since the incoming gas is heated by the heat from the combustion chamber walls, the absolute gas temperature is somewhere between the gas temperature upstream from the intake valves and the average surface temperature in the combustion chamber, which is dependent upon the operating point. This surface temperature may be represented as the sum of the coolant temperature and the drop in temperature across the combustion chamber wall, which is also dependent on the operating point.

At lower engine speeds, a relatively large amount of time is available for the heat exchange between the gas and the combustion chamber wall. If, at the same time, the load is small and thus the gas mass is also small, the gas temperature closely approximates the average surface temperature in the combustion chamber. Thus, the influence of the gas temperature upstream from the intake valves on the charge (absolute) temperature at the end of the intake process is minor, whereas the effect of the engine temperature is high. Conversely, at a high engine speed and a high load, the effect of the engine temperature is low but the effect of the gas temperature upstream from the intake valves is high. Therefore, the mass of the intake air at low speeds and low loads is mostly affected by changes in the engine temperature, but at high speeds and high loads, the mass is mostly affected by changes in the gas temperature upstream from the intake valves.

The present invention utilizes these relationships in calculating the correction factor by weighting the effects of intake air temperature and engine temperature on load sensing separately, according to the operating point. This weighting may be based on the deviations in the respective temperatures in relation to their value under standard conditions or their absolute value. Input variables for these new temperature compensations are:

- the intake air temperature upstream from the intake valves,
- the instantaneous engine temperature,
- either the engine speed and a load parameter (i.e., intake manifold pressure, throttle valve position or uncorrected basic injection time) or a signal derived from the intake air flow rate to describe the current operating point.

DETAILED DESCRIPTION

Figure 1:
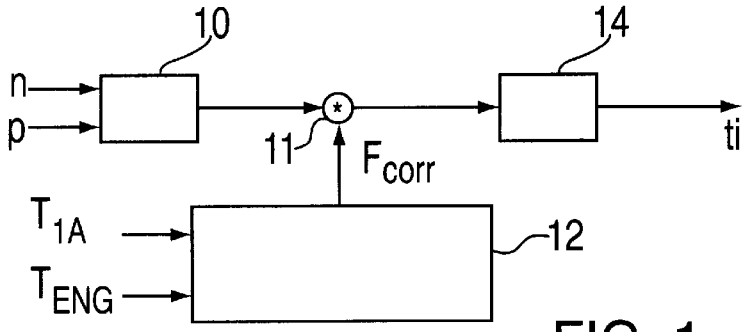
FIG. 1 PRIOR ART
FIG. 1 shows a schematic diagram of a device for controlling the amount of fuel supplied to an internal combustion engine as a function of operating characteristics, the basic structure of which is known.

FIG. 1 shows the basic structure for controlling the amount of fuel supplied to an internal combustion engine as a function of operating characteristics. Load sensing block 10 forms a load signal that depends on input signals representing the engine speed (n) and intake manifold pressure (p). In a downstream multiplication circuit 11, this load signal is multiplied by a correction factor $F_{CORR}$. This correction factor comes from a block 12 which compensates for temperature as a function of intake air temperature $T_{IA}$ and engine temperature $T_{ENG}$. The load signal which was corrected by means of correction factor $F_{CORR}$ undergoes other corrections known to those skilled in the art in a downstream block 14 whose output is an injection time signal ($t_i$).

The basic structure shown in FIG. 1 for forming injection time signals is known and shows the necessity of a temperature-dependent correction of a load signal that is formed from the pressure in the intake manifold of an internal combustion engine. The method of forming the correction factor has been repeatedly discussed in literature such as the references discussed above.

Figure 2:
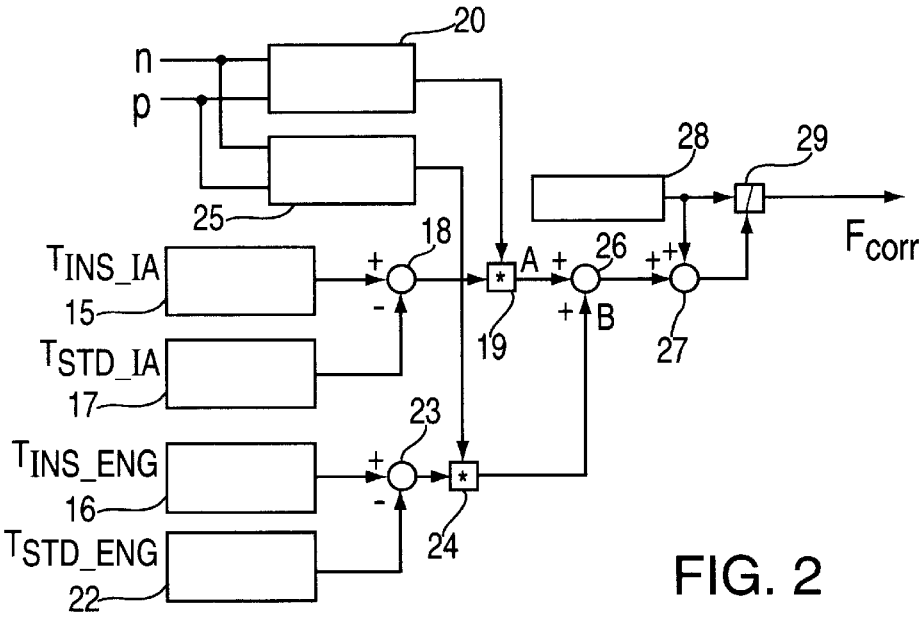
FIG. 2 shows an exemplary embodiment of the device according to the present invention which determines a correction factor, wherein the temperature deviations with respect to standard conditions are weighted.

FIG. 2 shows an exemplary embodiment of the present invention for determining the correction factor $F_{CORR}$. Block 15 represents a sensor for measuring the instantaneous intake air temperature $T_{INS_IA}$. Similarly, sensor 16 measures the instantaneous engine temperature $T_{INS_ENG}$. Block 17 outputs a signal corresponding to a standardized intake air temperature $T_{STD_IA}$. A subtraction circuit 18 subtracts the standardized intake air temperature $T_{STD_IA}$ from the instantaneous intake air temperature $T_{INS_IA}$. The resulting signal inputs into a multiplication circuit 19 which multiplies this signal by a weighting factor $F_1$ corresponding to the intake air temperature from an engine characteristics map 20, where the input variables for this engine characteristics map 20 are the signal values for the engine speed (n) and load (p).

A block 22 outputs a signal representing a standardized engine temperature $T_{STD_ENG}$. This signal value $T_{STD_ENG}$ is subtracted from the instantaneous engine temperature $T_{INS_ENG}$ in a subtraction circuit 23, and then multiplied in a multiplication circuit 24 by a weighting factor $F_2$ corresponding to the engine temperature in another engine characteristics map 25, whose input variables are also the engine speed (n) and load (p). The output signals of the two multiplication circuits 19 and 24 are then sent to an addition circuit 26 whose output signal is added in another addition circuit 27 to the output signal of block 28, which represents a typical gas temperature in the combustion chamber at the end of an intake cycle. This output signal from block 28 is also sent to division circuit 29, which divides this signal by the output signal of addition circuit 27, resulting in the correction factor $F_{CORR}$.

Essentially, the structure shown in FIG. 2 determines the ratios of the instantaneous values for intake air temperature and engine temperature to the standard values of these two temperatures, and these ratios are then weighted separately with factors $F_1$ and $F_2$ which are obtained from the engine characteristics map as a function of engine speed and load. The sum of these weighted values is then related to the typical gas temperature in the combustion chamber at the end of an intake cycle and, from this, the correction factor is formed. Correction factor $F_{CORR}$ can be expressed by the following formula:

$$F_{CORR}=T_{TYP}/(T_{TYP}+A+B)$$

where $T_{TYP}$=typical gas temperature;

$A=F_1(n,p)\cdot(T_{INS_IA}-T_{STD_IA})$; and $B=F_2(n,p)\cdot(T_{INS_ENG}-T_{STD_ENG})$.

The basic structure illustrated in FIG. 2 may be modified since the temperature values for the intake air temperature and the engine temperature need not necessarily be based on standard values and then weighted. Therefore, instead of putting both temperature values through this procedure, the structure could be modified to subject only one of these two temperature values to the procedure.

In addition, it is important for the instantaneous intake air temperature to approximate the temperature directly upstream from the intake valves of the internal combustion engine as much as possible. If the intake air temperature is not obtained directly upstream from the intake valves because the sensor is installed elsewhere, it should be derived by means of a model from temperature values obtained from sensors further upstream. The model must take into account the heating of the intake air in the hot intake manifold and, optionally, the additional heating due to external exhaust gas recirculation.

And in selecting weighting factors $F_1$ and $F_2$, it may be expedient, depending on the individual case, to set them relative to each other by having one factor be the complement of the other. Furthermore, a value of 350° K (output signal of block 28) has been found to be a typical gas temperature in the combustion chamber of a certain type of engine at the end of an intake cycle.

Figure 3:
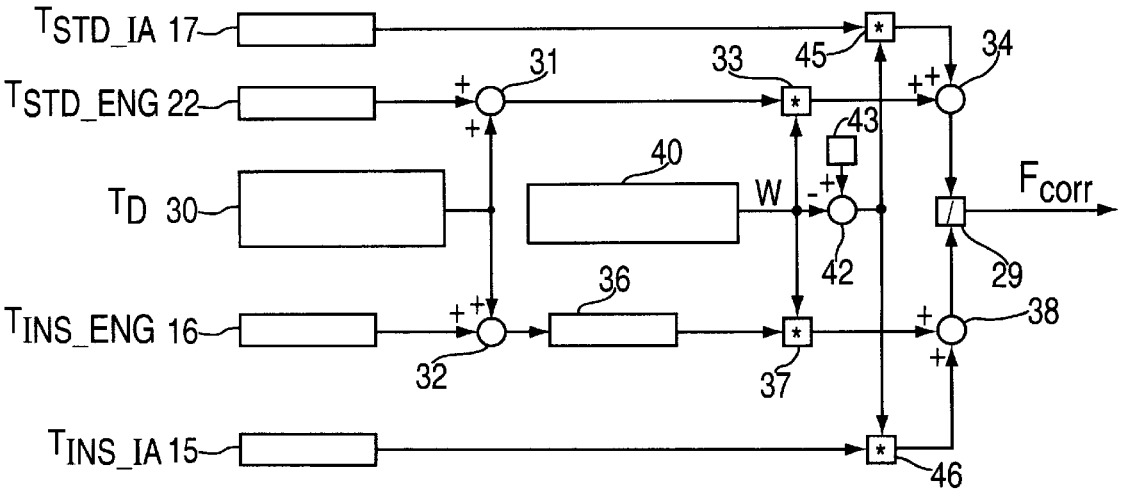
FIG. 3 shows a further embodiment of the device according to the present invention with weighting of the absolute temperatures.

FIG. 3 shows a further embodiment of the device according to the present invention, where the variables and blocks corresponding to those in FIG. 2 are labeled with the same combinations of letters and numbers.

A value for the temperature difference $T_D$ across the combustion chamber wall depending on the operating point is computed in a block 30, which sends its output signal to addition circuits 31 and 32 whose other inputs are, respectively, the signals representing the standardized engine temperature $T_{STD_ENG}$ and the instantaneous engine temperature $T_{INS_ENG}$. The output of addition circuit 31 is connected to division circuit 29 via a multiplication circuit 33 and a downstream addition circuit 34. The output signal of addition circuit 32 goes through a low-pass filter 36 to a multiplication circuit 37 which then supplies an input signal to a downstream addition circuit 38, whose output signal is the second input of division circuit 29. An operating point-dependent weighting factor W is formed in a block 40 and sent as the second input signal to multiplication circuits 33 and 37; it is also sent as the subtrahend to a subtraction circuit 42 whose second input receives a quantity (1 in this specific embodiment) from a block 43. Standardized intake air temperature $T_{STD_IA}$ (block 17) and instantaneous intake air temperature $T_{INS_IA}$ (block 15) are sent to multiplication circuits 45 and 46, whose second inputs are connected to the output signal of subtraction circuit 42. The output signals from multiplication circuits 45 and 46 are then sent to addition circuits 34 and 38, respectively, whose output signals provide the inputs to division circuit 29 which results in a correction factor $F_{CORR}$.

According to the structure shown in FIG. 3, correction factor $F_{CORR}$ is obtained with the formula:

$$F_{CORR}=U/V,$$

where $$U=T_{STD_IA}\cdot(1-W)+W\cdot(T_{STD_ENG}+T_D);$$

$$V=T_{INS_IA}\cdot(1-W)+W\cdot Ave(T_{INS_ENG}+T_D).$$

This formulation is obtained on the basis of the following physical considerations:

FIG. 3 shows a "more physical" variant than the embodiment illustrated in FIG. 2, but its parameters are more difficult to determine experimentally.

According to the general gas equation, the following formula describes the intake air mass per stroke:

$$MS=V_{CYL}\cdot p/(R\cdot T_F),$$

where

MS=intake air mass per stroke;

$V_{CYL}$=effective displacement of a cylinder (after subtracting the residual gas volume);

p=pressure in the combustion chamber at the end of the intake process (when the intake valve closes);

R=general gas constant;

$T_F$=charge (absolute) temperature in the combustion chamber at the end of the intake process.

The effective displacement and the pressure are independent of temperature in the first approximation, so the air mass is directly proportional to the reciprocal of the absolute temperature.

The required temperature compensation factor is thus the ratio of the charge temperature under standard conditions to the instantaneous charge temperature represented by the quotient U/V in the example given above.

In order to calculate the air mass, the gas temperature in the combustion chamber at the end of the intake process is used, but it cannot be measured directly. At any rate, it is higher than the temperature upstream from the intake valves because the incoming air is heated on the hot cylinder walls, but is lower than the combustion chamber surface temperature.

This can be represented with the following equation:

$$T_F=T_{IA}\cdot W\cdot(T_{AVE}-T_{IA})$$

or $$T_F=T_{IA}\cdot(1-W)+W\cdot T_{AVE}$$

where $T_F$=charge temperature in the combustion chamber at the end of the intake process;

$T_{IA}$=temperature of the air upstream from the intake valves;

W=operating point-dependent weighting factor, ranging from 0–1;

$T_{AVE}$=average surface temperature in the combustion chamber.

Since the surface temperature in the combustion chamber is not the same at all points, an average surface temperature is used. This average can be represented as the sum of either the cooling water temperature or engine temperature $T_{ENG}$, and the temperature difference across the combustion chamber wall $T_D$, as described by the following formula:

$$T_{AVE}=T_{ENG}+T_D.$$

The engine temperature $T_{ENG}$ is detected in each control device for the internal combustion engine. The temperature gradient $T_D$ across or inside the combustion chamber wall depends essentially only on the operating point and therefore can be stored in an engine characteristics map.

When there are rapid changes in the operating point, the engine temperature remains practically constant, and the temperature gradient in the combustion chamber wall has a thermal time constant of a few seconds. The low-pass filter shown takes this lag into account.

A steady-state equation for the correction factor is:

$$F_{CORR}=[T_{STD_IA}\cdot(1-W)+(T_{ENG}+T_D)\cdot W]/[T_{IA}\cdot(1-W)+(T_{ENG}+T_D)\cdot W].$$

Starting with this equation for the example in FIG. 3, the equation for the $F_{CORR}$ in the structure shown in FIG. 2 is obtained through the following reasoning:

The steady-state equation given above can be rewritten as follows:

$$T_{IA}=T_{STD_IA}+\Delta T_{IA}$$

and $$T_{ENG}=T_{STD_ENG}+\Delta T_{ENG}$$

as follows:

$$F_{CORR}=[T_{STD_IA}\cdot(1-W)+(T_{STD_ENG}+T_D)\cdot W]/[\Delta T_{IA}\cdot(1-W)+\Delta T_{ENG}\cdot W+T_{STD_IA}(1-W)+(T_{STD_ENG}+T_D)\cdot W].$$

The term for the standard charge temperature, $$T_{STD_IA}\cdot(1-W)+(T_{STD_ENG}+T_D)\cdot W,$$

which occurs in both the numerator and denominator, is always on the order of approximately 350° K (330° K–380° K, depending on the operating point) and is much larger than the term $$\Delta T_{IA}\cdot(1-W)+\Delta T_{ENG}\cdot W,$$

which describes the deviation between the instantaneous charge temperature and the standard charge temperature and is in the range of −60° to +20° C. (excluding cold starts in winter). Therefore, the errors in the correction factor are relatively minor when the standard charge temperature is replaced by a fixed value of approximately 350° K:

$$F_{CORR}=[350°\ K]/[\Delta T_{IA}\cdot(1-W)+\Delta T_{ENG}\cdot W+350°\ K],$$

where $F_1$=(1−W);

$F_2$=W, thus yielding the structure illustrated in FIG. 2.

What is claimed is:

1. A device for controlling an amount of fuel provided to an internal combustion engine having operating characteristics, the amount of fuel being controlled as a function of the operating characteristics, the device comprising:

first means for receiving at least one first input signal indicative of an operating characteristic of the internal combustion engine;

second means for receiving a first temperature signal indicative of an intake air temperature of the internal combustion engine;

third means for receiving a second temperature signal indicative of an internal temperature of the internal combustion engine;

first means for generating a first output signal as a function of the first temperature signal;

second means for generating a second output signal as a function of the second temperature signal;

third means for generating a first weighting factor as a function of the at least one first input signal;

fourth means for generating a second weighting factor separately from the first weighting factor, as a function of the at least one first input signal;

first means for weighting the first output signal with the first weighting factor;

second means for weighting the second output signal with the second weighting factor;

means for determining a correction factor as a function of the weighted first and second output signals; and means for correction factor correcting a load signal of the internal combustion engine as a function of the correction factor.

2. The device according to claim 1, further comprising:

fourth means for receiving a third temperature signal corresponding to a standard value for the intake air temperature of the internal combustion engine; and fifth means for receiving a fourth temperature signal corresponding to a standard value for the internal temperature of the internal combustion engine, wherein the second means for receiving the first temperature signal includes a first plurality of sensors, the first plurality of sensors detecting an instantaneous intake air temperature in the internal combustion engine;

wherein the third means for receiving the second temperature signal includes a second sensor, the second sensor detecting an instantaneous internal temperature in the internal combustion engine;

wherein the first means for generating the first output signal generates the first output signal by forming a first relationship between the first and third temperature signals; and wherein the second means for generating the second output signal generates the second output signal by forming a second relationship between the second and fourth temperature signals.

3. The device according to claim 2, wherein the first plurality of sensors is arranged adjacent to a corresponding plurality of intake valves in the internal combustion engine.

4. The device according to claim 2, wherein the first temperature signal is derived from a simulated model using a fifth temperature signal provided from the plurality of sensors placed upstream from a corresponding plurality of intake valves in the internal combustion engine.

5. The device according to claim 1, further comprising:

a third sensor, the third sensor detecting a speed of the internal combustion engine;

a fourth sensor, the fourth sensor detecting at least one load parameter of the internal combustion engine, the at least one load parameter including at least one of an intake manifold pressure, a throttle valve position, and an uncorrected basic injection time; and means for forming the load signal from the speed and the at least one load parameter of the internal combustion engine.

6. The device according to claim 1, further comprising:

a third sensor, the third sensor detecting a speed of the internal combustion engine;

second means for providing a second input signal proportional to the intake air flow rate; and means for forming the load signal from the speed and the second input signal.

7. A device for controlling an amount of fuel supplied to an internal combustion engine having operating characteristics, the amount of fuel being regulated as a function of the operating characteristics, the device comprising:

first means for receiving at least one first input signal indicative of the operating characteristics of the internal combustion engine;

second means for receiving a first temperature signal from a first plurality of sensors, the first plurality of sensors detecting an instantaneous intake air temperature in the internal combustion engine;

third means for receiving a second temperature from a second sensor, the second sensor detecting an instantaneous internal temperature in the internal combustion engine;

fourth means for receiving a third temperature signal corresponding to a standard value for the intake air temperature of the internal combustion engine;

fifth means for receiving a fourth temperature signal corresponding to a standard value for the internal temperature of the internal combustion engine;

sixth means for receiving a fifth temperature signal indicative of a temperature difference across a wall of a combustion chamber in the internal combustion engine;

first means for determining a first weighting factor as a function of an operating point of the internal combustion engine;

second means for determining a second weighting factor separately from the first weighting factor, as a function of the operating point of the internal combustion engine;

third means for determining an instantaneous charge temperature by weighting the first temperature signal with the second weighting factor to form a first result and adding the first result to a sum of the second and fifth temperature signal weighted with the second weighting factor;

fourth means for determining a standard charge temperature by weighting the third temperature signal with the second weighting factor to form a second result and adding the second result to an average of a sum of the fourth and fifth temperature signal weighted with the first weighting factor;

fifth means for determining a correction factor by dividing the standard charge temperature by the instantaneous charge temperature; and means for correcting a load signal of the internal combustion engine as a function of the correction factor.

8. The device according to claim 7, wherein the first and second weighting factors are complements of each other, and wherein the correction factor ($F_{CORR}$) is calculated as follows:

$$F_{CORR}=U/V;$$

$$U=T_{STD_IA}\cdot(1-W)+W\cdot(T_{STD_ENG}+T_D);$$

$$V=T_{IA}\cdot(1-W)+W\cdot(Ave(T_{ENG}+T_D)-T_{IA}),$$

where

W is one of the first and second weighting factors;

$T_{IA}$ is the instantaneous value of the air intake temperature;

$T_{STD_IA}$ is the standard value of the air intake temperature;

$T_{ENG}$ is the instantaneous value of the internal engine temperature;

$T_{STD_ENG}$ is the standard value of the internal engine temperature;

$T_D$ is a temperature difference across a combustion chamber wall;

$Ave(T_{ENG}+T_D)$ is an averaged total of $T_{ENG}$ and $T_D$.

9. The device according to claim 8, wherein a value of the temperature difference across the combustion chamber wall in the internal combustion engine is obtained from an engine characteristics map as a function of the operating point of the internal combustion engine.

10. A method for controlling an amount of fuel supplied to an internal combustion engine having operating characteristics, the amount of fuel being controlled as a function of the operating characteristics, the method comprising the steps of:

receiving at least one first input signal indicative of an operating characteristic of the internal combustion engine;

receiving a first temperature signal indicative of an intake air temperature in the internal combustion engine;

receiving a second temperature signal indicative of an internal temperature in the internal combustion engine;

generating a first output signal as a function of the first temperature signal;

generating a second output signal as a function of the second temperature signal;

determining a first weighting factor as a function of the at least one first input signal;

determining a second weighting factor, separately from the determination of the first weighting factor, as a function of the at least one first input signal;

weighting the first output signal with the first weighting factor;

weighting the second output signal with the second weighting factor;

determining a correction factor as a function of the weighted first output signal and the weighted second output signal; and correcting a load signal of the internal combustion engine as a function of the correction factor.

11. The method according to claim 10, further comprising the steps of:

receiving a third temperature signal corresponding to a standard value for the intake air temperature of the internal combustion engine; and receiving a fourth temperature signal corresponding to a standard value for the internal temperature of the internal combustion engine, wherein the first temperature signal is provided by a first plurality of sensors, the first plurality of sensors detecting an instantaneous intake air temperature in the internal combustion engine, and wherein the second temperature signal is provided by a second sensor, the second sensor detecting an instantaneous internal temperature in the internal combustion engine, and wherein the first output signal is determined by forming a first relationship between the first and third temperature signal, and wherein the second output signal is determined by forming a second relationship between the second and fourth temperature signal.

12. The method according to claim 11, wherein the first temperature signal is derived from a simulated model using a fifth temperature signal provided from a plurality of sensors upstream from a corresponding plurality of intake valves in the internal combustion engine.

13. The method according to claim 10, further comprising the steps of:

providing a second input signal from a third sensor, the third sensor detecting a speed of the internal combustion engine;

providing a third input signal indicative of a load of the internal combustion engine, the third input signal being provided from a fourth sensor detecting at least one of an intake manifold pressure, a throttle valve position, and an uncorrected basic injection time; and forming the load signal from the second and third input signals.

14. The method according to claim 10, further comprising the steps of:

providing a second input signal from a third sensor, the third sensor detecting a speed of the internal combustion engine;

providing a fourth input signal proportional to an intake air flow rate; and forming the load signal from the second and fourth input signals.

15. A method for controlling an amount of fuel supplied to an internal combustion engine having operating characteristics, the amount of fuel being regulated as a function of the operating characteristics, the method comprising the steps of:

receiving at least one first input signal indicative of the operating characteristics of the internal combustion engine;

receiving a first temperature signal from a first plurality of sensors, the first plurality of sensors detecting an instantaneous intake air temperature in the internal combustion engine;

receiving a second temperature from a second sensor, the second sensor detecting an instantaneous internal temperature in the internal combustion engine;

receiving a third temperature signal corresponding to a standard value for the intake air temperature of the internal combustion engine;

receiving a fourth temperature signal corresponding to a standard value for the internal temperature of the internal combustion engine;

receiving a fifth temperature signal indicative of a temperature difference across a wall of a combustion chamber in the internal combustion engine;

determining a first weighting factor as a function of an operating point of the internal combustion engine;

determining a second weighting factor separately from the first weighting factor, as a function of the operating point of the internal combustion engine;

determining an instantaneous charge temperature by weighting the first temperature signal with the second weighting factor to form a first result and adding the first result to a sum of the second and fifth temperature signal weighted with the second weighting factor;

determining a standard charge temperature by weighting the third temperature signal with the second weighting factor to form a second result and adding the second result to an average of a sum of the fourth and fifth temperature signal weighted with the first weighting factor;

determining a correction factor by dividing the standard charge temperature by the instantaneous charge temperature; and correcting a load signal of the internal combustion engine as a function of the correction factor.

16. The method according to claim 15, wherein the first and second weighting factors are complements of each other, and wherein the correction factor ($F_{CORR}$) is calculated as follows:

$$F_{CORR}=U/V;$$

$$U=T_{STD_IA}\cdot(1-W)+W\cdot(T_{STD_ENG}+T_D);$$

$$V=T_{IA}\cdot(1-W)+W\cdot(Ave(T_{ENG}+T_D)-T_{IA}),$$

where

W is one of the first and second weighting factors;

$T_{IA}$ is the instantaneous value of the air intake temperature;

$T_{STD_IA}$ is the standard value of the air intake temperature;

$T_{ENG}$ is the instantaneous value of the internal engine temperature;

$T_{STD_ENG}$ is the standard value of the internal engine temperature;

$T_D$ is a temperature difference across a combustion chamber wall;

$Ave(T_{ENG}+T_D)$ is an averaged total of $T_{ENG}$ and $T_D$.

17. The method according to claim 16, wherein a value of the temperature difference across the combustion chamber wall in the internal combustion engine is obtained from an engine characteristics map as a function of the operating point of the internal combustion engine.

* * * * *